US006789479B2

(12) United States Patent
Göttling et al.

(10) Patent No.: US 6,789,479 B2
(45) Date of Patent: Sep. 14, 2004

(54) APPARATUS FOR HANDLING SLEEVES ON PRESS CYLINDERS

(75) Inventors: Josef Göttling, Friedberg (DE); Thomas Hartmann, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/628,002

(22) Filed: Jul. 25, 2003

(65) Prior Publication Data

US 2004/0139873 A1 Jul. 22, 2004

(30) Foreign Application Priority Data

Jul. 26, 2002 (DE) ..... 102 34 329

(51) Int. Cl.[7] ..... B41F 13/10
(52) U.S. Cl. ..... 101/375; 101/479; 492/4
(58) Field of Search ..... 101/477, 479, 101/483, 375

(56) References Cited

U.S. PATENT DOCUMENTS 4,549,923 A 10/1985 Tachibana et al.
5,072,504 A * 12/1991 Thompson ..... 101/375
5,537,923 A * 7/1996 Boor et al. ..... 101/375
5,743,539 A * 4/1998 VanderPol et al. ..... 279/58
5,802,975 A 9/1998 Prem et al.
6,250,223 B1 * 6/2001 Dufour ..... 101/375
6,386,103 B1 5/2002 Charette et al.

* cited by examiner

*Primary Examiner*—Eugene H. Eickholt
(74) *Attorney, Agent, or Firm*—Cohen, Pontani, Lieberman & Pavane

(57) ABSTRACT

An apparatus for mounting a printing sleeve on a press cylinder includes an inherently stiff annular holding element having an inner shape which is matched to the outer shape of the sleeve, and mutually facing ends defining a slit having a width. At least one clamp urges the ends toward each other to form a butt joint, so that the holding element can clamp the sleeve with a clamping force which is limited by the width of the slit. A device is provided for expanding the holding element so that the clamping force on the sleeve can be released.

12 Claims, 3 Drawing Sheets

APPARATUS FOR HANDLING SLEEVES ON PRESS CYLINDERS

BACKGROUND OF THE INVENTION

1. Field of the Invention

The invention relates to an apparatus for handling sleeves on press cylinders having a slit annular inherently stiff holding element which is matched to the outer shape of the sleeve and clamps around the sleeve on its circumferential surface with a clamping force so that the sleeve can be held with a form fit.

2. Description of the Related Art

U.S. Pat. No. 5,802,975 discloses a device for handling sleeves on cylinders, which displaces printing-forme sleeves or rubber coated sleeves over the free end of cantilever-mounted printing unit cylinders. For this purpose, a sleeve gripping system is provided on the corresponding printing unit cylinders, which grips the surface of the sleeve with a guide element with a force fit at a predeterminable axial position and displaces the sleeve in the axial direction on the printing unit cylinder using a pneumatic cylinder.

U.S. Pat. No. 4,549,923 discloses dismantling pieces which enclose a sleeve in a ring shape and may be clamped around the sleeve by clamping means. One of the dismantling pieces is designed in the form of an open ring, which is provided at its opposite ends with lugs which may be pulled together by a screw in such a way that the annular part is clamped around the sleeve. Another design shows an annular dismantling piece which is divided into two separate halves, between which the sleeve is clamped. Provided on both halves in each case are grip pieces, on which springs or pneumatic cylinders act in order to clamp the sleeve.

U.S. Pat. No. 6,250,223 likewise relates to an apparatus for removing a printing sleeve from a cantilever-mounted cylinder. As already disclosed by U.S. Pat. No. 5,802,975, contact elements that can be positioned axially on the circumference of the printing sleeve are provided and are set against the printing sleeve in order to produce a frictional force. For this purpose, in one exemplary embodiment from U.S. Pat. No. 6,250,223, a band of inherently rigid material is provided, which is matched to the external shape of the printing sleeve. Using a clamping device, this band may be clamped around the printing sleeve, analogous to the dismantling piece from U.S. Pat. No. 4,549,923.

In all off these prior art apparatuses, there is the risk of damaging the printing sleeve.

SUMMARY OF THE INVENTION

It is an object of the present invention to provide an apparatus for handling sleeves on press cylinders which ensures that a printing sleeve is picked up and held stably and which rules out damage.

According to the invention, the holding element has mutually facing ends defining a slit having a width. At least one clamp urges the ends toward each other so that the clamping force is limited by the width of the slit. A device for expanding the holding element is provided, so that the clamping force on the sleeve can be released. The apparatus according to the present invention makes it possible, in an advantageously simple way, to push sleeves (printing-plate sleeves with or without seam or rubber blanket sleeves) onto press cylinders and to pull them off.

Using the apparatus according to the present invention, sleeves can be picked up carefully and at the same time stably and without damage, such as indentations or bends, can advantageously be avoided.

In particular the shape of sleeves of large diameter can be stabilized in an excellent manner by the apparatus according to the present invention, which means that pushing such sleeves on and pulling them off is significantly simplified.

Using a slit holding element, the apparatus can advantageously be adapted to the differences in diameter when the sleeve is widened in order to push it on or pull it off the cylinder. At the same time, this measure makes it simple to pick the sleeve up in the apparatus.

In an apparatus designed in accordance with the present invention, an unstable sleeve becomes a relatively stiff, easily handled tube.

The apparatus makes it possible to bring the printing sleeves into a predefined position in relation to their circumferential and their axial position, that is to say they can be fitted to a press cylinder with an accurate fit and in register.

Using a mounting aid, the fitting of a sleeve to a press cylinder can be simplified still further, since the said aid permits the sleeve to be pushed on without canting.

As a result of the provision of damping elements on the apparatus according to the present invention, vibrations of the sleeves can be damped, which means that an advantageous reduction in the noise nuisance is achieved.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The terms printing sleeve or sleeve used in relation to the present invention also include printing plate sleeves, seamless sleeves which are used as a printing forme, and also rubber blanket sleeves—with or without a seam.

Figure 1:
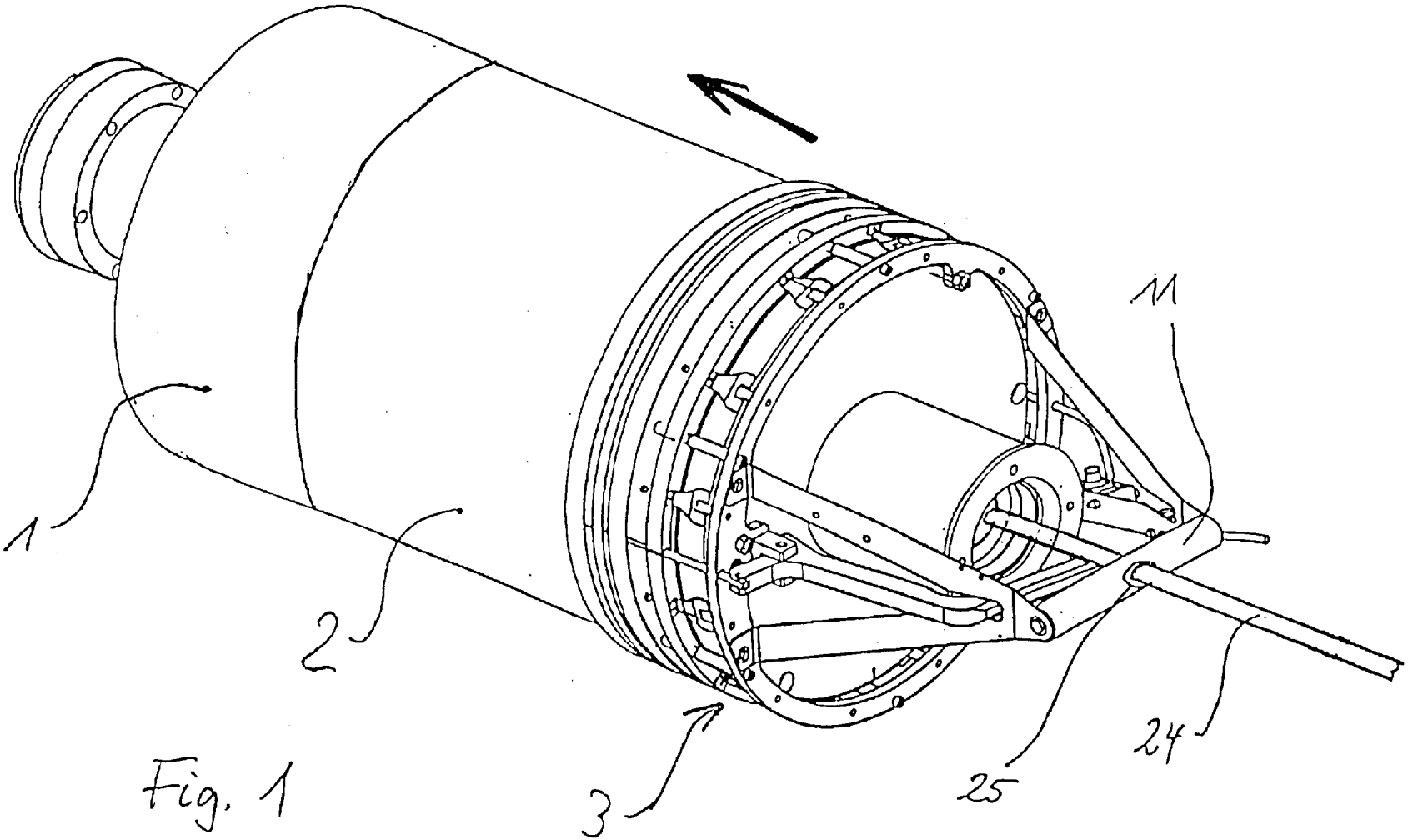
FIG. 1 is a perspective view of the apparatus for handling sleeves on press cylinders with a sleeve when being fitted to a press cylinder.

FIG. 1 shows a cantilever-mounted press cylinder 1, onto which a sleeve 2 is being pushed. For this purpose, the sleeve 2 is picked up at its one end by an apparatus 3 designed in accordance with the present invention and is placed with its other free end on the cylinder 1. In order to hold the sleeve 2 and push it on in the direction of the arrow, a handle 11 is provided on the apparatus 3. In order to prevent canting as the sleeve 2 is pushed on, it may be advantageous to provide a mounting aid 24. The mounting aid 24 is arranged coaxially with the cylinder 1 as an extension of the axis of rotation and interacts with a hole 25 on the apparatus 3. The mounting aid 24 is preferably designed as a cylindrical rod or tube and is arranged in such a way that the apparatus 3 with the sleeve 2 is first threaded into the hole 25 and guided before the front end of the sleeve 2 is placed on the cylinder 1. In order to make it easier to fit the sleeve 2 or pull it off the cylinder 1, compressed air can be blown into the interspace between the surface of the cylinder 1 and the sleeve 2, as a result of which the internal diameter of the sleeve 2 widens. As soon as the sleeve 2 is positioned on the press cylinder, the apparatus 3 and the mounting aid 24 can be removed.

Figure 2:
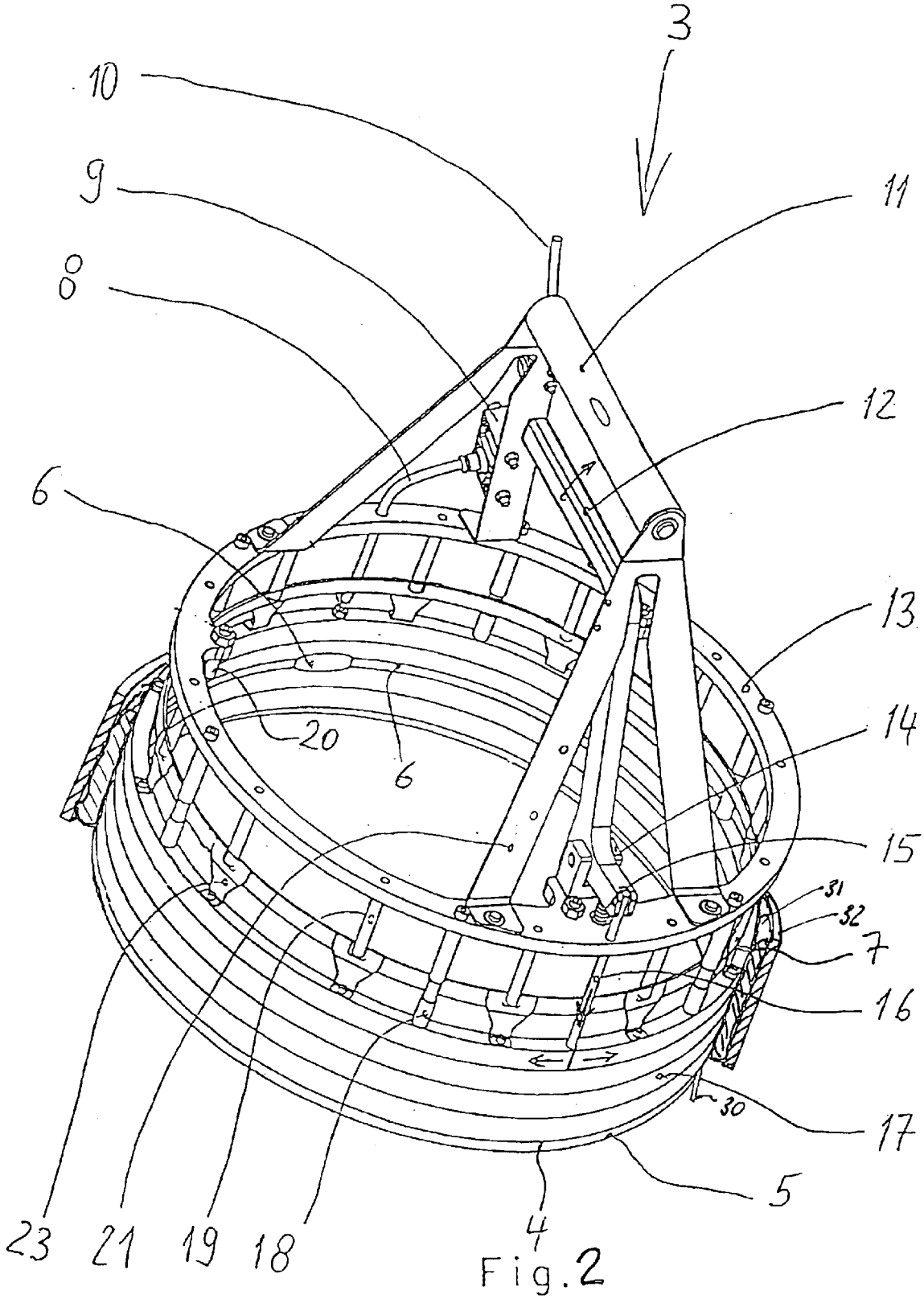
FIG. 2 is a perspective view of the apparatus by itself.

An exemplary embodiment of the apparatus 3 according to the invention will be described in more detail using FIG. 2. The apparatus 3 for handling sleeves on press cylinders substantially comprises an annular inherently rigid holding element 5, which is matched to the respective outer shape of the corresponding sleeve and is provided in order to hold the sleeve.

An appropriate apparatus 3 can be provided for each sleeve diameter. However, it is also possible to provide, for smaller sleeve diameters, reducing pieces which bridge the difference in diameter between the outer diameter of the sleeve and the holding element 5.

The holding element 5 is connected via spacers 18 to a holding ring 13, on which holders 21 with a handle 11 are arranged.

The annular holding element 5 is preferably produced from a suitable plastic and has an internal diameter corresponding approximately to the sleeve diameter. The holding element 5 is slit parallel to the main axis of the sleeve and clamped around by one or more rubber bands 17, so that the opposite butt joint points on the slit 4 are pressed against one another. As a result, the original circumferential length of the holding element 5 is shortened by the width of the slit 4, which results in a reduction in the internal diameter. As a result of this reduction in the internal diameter, a normal force acts on the surface of the sleeve—held in the holding element 5—and produces a frictional force between the sleeve and the holding element 5, so that the sleeve is held with a force fit. The difference in diameter between the sleeve and the holding element 5, and therefore the clamping force on the sleeve, is defined and limited by the width of the slit. The wider the slit, the greater the difference in diameter and the force which acts on the sleeve. If the slit is provided so as to be too wide, then the full clamping force of the rubber bands 17 can come into effect. The width of the slit 4 is preferably chosen such that the internal diameter of the holding element 5 may be compressed to approximately the dimension of the external diameter of the sleeve or slightly less.

Figure 3:
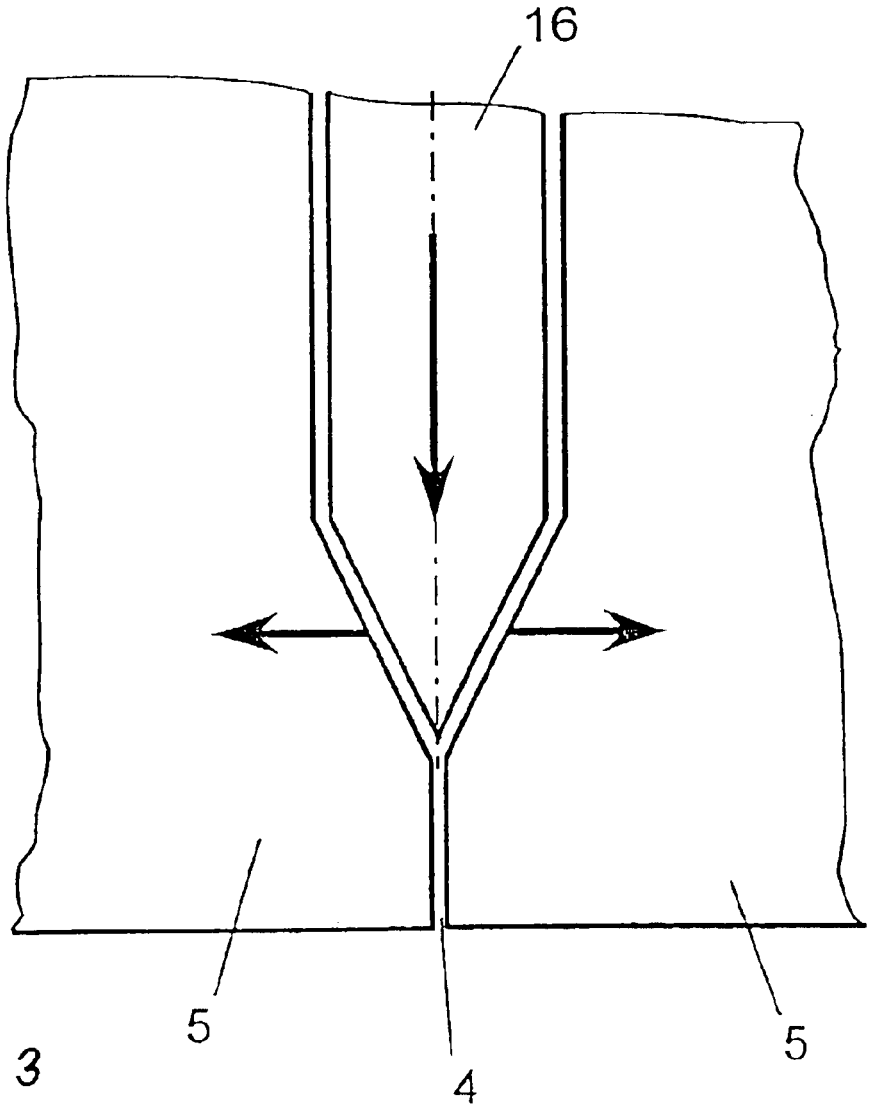
FIG. 3 is a schematic view of a spreader element interacting with a holding element.

In order to hold a sleeve with the apparatus 3, the circumference of the holding element 5 can be widened counter to the tensioning of the rubber bands 17. For this purpose, a recess is provided at the joint, accommodating a spreading element 16. The spreading element 16 is connected in a jointed manner to a lever 12 rotatably mounted on a bearing block 14. By pulling on the lever 12, the spreading element 16 can be displaced in the slit 4 counter to the force of a spring 15. Provided on the spreading element 16 are surfaces, preferably inclined with respect to the direction of movement, for example a conical jacket, which are braced against the holding element 5 with corresponding surfaces and, as a result, widen the slit 4. This is illustrated schematically in FIG. 3, which represents the corresponding detail of the slit 4.

In order to pick up a printing sleeve, the apparatus 3 with the lever 12 pulled—resting on the handle 11—is placed on a sleeve, preferably standing upright. First stops 19 can be provided on the holding ring 13, defining the axial position of the sleeve in the holding element 5. As soon as the sleeve is resting on the stops 19—arranged distributed uniformly on the circumference—and a welded seam which may be present on the sleeve is aligned with a marking 7—applied to the holding element 5—the lever 12 can be unclamped, so that the sleeve is held with a force fit in the apparatus 3.

In order to increase the frictional force, the inner wall of the holding element 5 can be coated with a material which in interaction with the surface of the sleeve results in a greater coefficient of friction, or an adhesive agent, such as adhesives, can be applied.

Another possible way of improving the force fit is to increase the normal force on the surface of the sleeve. For this purpose, on the inner wall of the holding element 5—facing the sleeve—one or more circumferential depressions 6 can be provided, which are connected to a vacuum connection 8. The contacting circumferential surface of the sleeve seals off the depression 6 with respect to the ambient air pressure, as a result of which it is sucked against the inner wall of the holding element 5 because of the effect of a vacuum. To this end, it can be advantageous to provide a vacuum generator 9 on the apparatus 3. The vacuum generator 9 can be connected to a compressed air connection 10 and converts the positive pressure into a negative pressure.

In order to increase the clamping force further, additional clamping force can be provided which—for example in the form of clamping bands—are placed externally over the holding element 5 and can be tensioned using mechanical, pneumatic, hydraulic, or electrical actuating devices. This could be a hydraulically or pneumatically inflatable clamping element 31, which is placed externally around the holding element 5 and, in the inflated state, is supported on an enclosing rigid supporting ring 32 and exerts a clamping force inwardly on the holding element 5.

It is also possible for hose-like inflatable clamping elements to be provided between the inner circumference of the holding element 5 and the outer diameter of the sleeve.

After the sleeve has been picked up in the apparatus in accordance with the respective requirements, it can be fitted to a press cylinder 1 as explained using FIG. 1. In order to mount the sleeve 2 on the press cylinder 1 in accurate page register, in addition to the first stops 19 (FIG. 2) which define the axial position of the sleeve with respect to the apparatus 3, further stops 20 can be provided, which limit the pushing-on movement on the cylinder. As a result, all the printing sleeves with the various images for the different printing inks can be fitted to the various press cylinders in the same relative axial position with respect to the printed product, so that the inks are applied successively exactly one above another.

In order to perform positioning in the circumferential direction of the printing sleeves as well, a marking 7 can be provided on the apparatus 3, with which marking, for example, the seam of a welded printing sleeve can be aligned. When the sleeve is pushed on, the marking 7 of the apparatus 3 is aligned with the further marking on the press cylinder, so that the welded seam rests on the cylinder at a predetermined circumferential position. For the purpose of alignment in the circumferential direction, a pin 30 could be provided on the apparatus 3, penetrating into a corresponding receptacle—for example a hole—on the press cylinder.

In order to reduce the noise nuisance which occurs when the sleeves are being pushed on and pulled off, is produced by compressed air and arises because the sleeves are set into vibration, damping elements 23 can be provided on the apparatus 3, rest on the outside of the sleeve and, as a result, damp the vibrations of the sleeve.

If the sleeve is widened by compressed air when being fitted or pulled off, then the holding element 5 can advantageously adapt to the differences in diameter, counter to the clamping force of the rubber bands 17.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. An apparatus for mounting a printing sleeve on a press cylinder, said sleeve having an outer shape, said apparatus comprising:

an inherently stiff annular holding element having an inner shape which is matched to the outer shape of said sleeve, said holding element having mutually facing ends defining a slit having a width;

at least one clamp which urges the ends toward each other so that the holding element can clamp the sleeve with a clamping force which is limited by the width of the slit; and means for expanding the holding element so that the clamping force on the sleeve can be released.

2. An apparatus as in claim 1 wherein the width of the slit is chosen so that, when said ends form a butt joint, the holding element has an inside diameter which is less than or equal to the outer diameter of the sleeve.

3. An apparatus as in claim 1 wherein said at least one clamp comprises a rubber band which surrounds the holding element.

4. An apparatus as in claim 1 wherein said holding element has an inner wall with a depression having a vacuum connection so that the surface of the sleeve can be sucked against the inner wall.

5. An apparatus as in claim 1 wherein the holding element has an inner wall coated with a material which results in a high friction contact with said sleeve.

6. An apparatus as in claim 1 wherein said means for expanding the holding element comprises a spreading element received between said ends.

7. An apparatus as in claim 1 further comprising a clamping band placed around the outside of the holding element, and at least one actuating device for actuating the clamping band, said actuating device being one of a mechanical, pneumatic, hydraulic, and electric actuating device.

8. An apparatus as in claim 7 further comprising a supporting ring surrounding said clamping band, said clamping band comprising one of a hydraulically and pneumatically inflatable clamping element supported on the outside by said supporting ring and exerting an inward holding force on said holding element when inflated.

9. An apparatus as in claim 1 further comprising first axial stops on said holding element for axially positioning the sleeve, and second axial stops for axially positioning the holding element relative to press cylinder, whereby the sleeve can be mounted in accurate page register on the press cylinder.

10. An apparatus as in claim 1 wherein said holding element comprises a marking which can be aligned with a seam on the sleeve, said apparatus further comprising an element which can engage a receptacle on the press cylinder so that the seam can be aligned in a predetermined circumferential position with respect to the cylinder.

11. An apparatus as in claim 1 further comprising damping elements which grip the sleeve circumferentially and damp vibrations of the sleeve.

12. An apparatus as in claim 1 further comprising a guide which cooperates with a mounting aid on a press cylinder to guide the sleeve coaxially with respect to a cylinder axis as the sleeve is fitted to the cylinder.

* * * * *